US009725678B2

(12) United States Patent
Bettiol et al.

(10) Patent No.: US 9,725,678 B2
(45) Date of Patent: Aug. 8, 2017

(54) OPTIMIZED SURFACTANT RATIO FOR IMPROVED RINSE FEEL

(71) Applicant: The Procter & Gamble Company, Cincinnati, OH (US)

(72) Inventors: Jean-Luc Philippe Bettiol, Etterbeek (BE); Karl Ghislain Braeckman, Gerpinnes (BE); Frederik Clara P Vandenberghe, Sint-Amands (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/722,182

(22) Filed: May 27, 2015

(65) Prior Publication Data

US 2015/0344821 A1 Dec. 3, 2015

Related U.S. Application Data

(60) Provisional application No. 62/004,855, filed on May 29, 2014.

(51) Int. Cl.

| | |
|---|---|
| ***C11D 1/29*** | (2006.01) |
| ***C11D 1/75*** | (2006.01) |
| ***C11D 1/90*** | (2006.01) |
| ***C11D 1/94*** | (2006.01) |
| ***C11D 1/14*** | (2006.01) |
| ***C11D 1/88*** | (2006.01) |
| ***C11D 1/72*** | (2006.01) |
| ***C11D 1/66*** | (2006.01) |
| ***C11D 3/20*** | (2006.01) |
| ***C11D 1/83*** | (2006.01) |

(52) U.S. Cl.

CPC ..... *C11D 1/94* (2013.01); *C11D 1/14* (2013.01); *C11D 1/143* (2013.01); *C11D 1/66* (2013.01); *C11D 1/72* (2013.01); *C11D 1/83* (2013.01); *C11D 1/88* (2013.01); *C11D 1/90* (2013.01); *C11D 3/2003* (2013.01); *C11D 1/29* (2013.01); *C11D 1/75* (2013.01)

(58) Field of Classification Search

CPC .... C11D 1/14; C11D 1/29; C11D 1/66; C11D 1/72; C11D 1/75; C11D 1/90; C11D 1/94; C11D 3/2003

USPC ..... 510/237, 424, 427, 503, 505, 506

See application file for complete search history.

(56) References Cited

U.S. PATENT DOCUMENTS

2013/0029894 A1 1/2013 Bettiol et al.

FOREIGN PATENT DOCUMENTS

| | | |
|---|---|---|
| WO | WO9520027 A1 | 7/1995 |
| WO | WO0244312 A2 | 6/2002 |
| WO | WO2006055570 A1 | 5/2006 |

*Primary Examiner* — Gregory R Delcotto

(74) *Attorney, Agent, or Firm* — Lauren Christine Gonzalez; Gary J. Foose; Amy I. Ahn-Roll

(57) ABSTRACT

The invention relates to a detergent composition having a ratio of surfactants optimized for clean rinse feel.

12 Claims, No Drawings

OPTIMIZED SURFACTANT RATIO FOR IMPROVED RINSE FEEL

FIELD OF THE INVENTION

The present invention relates to liquid detergent compositions with improved rinse feel.

BACKGROUND OF THE INVENTION

Squeaky clean, attributable to efficient rinsing, is important to many consumer segments, particularly in hand dishwashing. For example, this squeaky clean is referred to as "kyu-kyu" in Japan. To provide this benefit, liquid dish detergent compositions often contain anionic surfactants having a relatively high degree of alkoxylation, especially ethoxylation, making them more water soluble. However, a drawback to these highly alkoxylated anionic surfactants is sacrificing efficient grease or oil removal. Accordingly, there is a need for a liquid detergent composition that balances squeaky clean benefits and the use of anionic surfactants with low degree of alkoxylation for grease removal.

SUMMARY OF THE INVENTION

The present invention addresses this need by providing an anionic surfactant with a relatively low degree of alkoxlation and striking the balance between squeaky feel and efficient grease (or oil) removal by providing an optimized weight ratio of the anionic surfactant and co-surfactant and nonionic surfactant.

One advantage of the present invention is good squeaky feel while having efficient grease removal. Another advantage is a detergent composition that provides suds longevity.

One aspect of the invention provides a liquid detergent composition comprising: (a) 1%-60%, preferably 5% to 50%, of a surfactant system by weight of the composition, wherein the surfactant system comprises: (i) 35% to 49%, preferably from 37% to 47% of an alkyl sulphate surfactant by weight of the surfactant system, wherein the alkyl sulphate surfactant having the formula: $R_1O(A)_xSO_3M$, wherein: $R_1$ is a $C_1$-$C_{21}$ alkyl or alkenyl group, preferably from $C_8$-$C_{20}$; A is an alkoxy group, preferably a $C_1$-$C_5$ alkoxy group, more preferably a $C_1$-$C_3$ alkoxy group; x represents mole percentage average below 1, preferably from 0 to below 1; and M is an cation, preferably the cation is selected from an alkali metal, alkali earth metal, ammonium group, or alkanolammonium group; (ii) 35% to 49%, preferably from 37% to 47%, more preferably from 40% to 44%, of co-surfactant by weight of the surfactant system, wherein the co-surfactant is selected from an amphoteric surfactant, zwitterionic surfactant, and mixtures thereof; and (iii) 12% to 22%, preferably from 15% to 19%, of a nonionic surfactant by weight of the surfactant system; and (b) water.

Another aspect of the present invention provides a liquid dish detergent composition comprising: (a) 26%-38% of a surfactant system by weight of the liquid dish composition, wherein the surfactant system comprises: (i) 40% to 44% of an alkyl sulphate surfactant by weight of the surfactant system, wherein the alkyl sulphate surfactant having the formula: $R_1O(A)_xSO_3M$, wherein: $R_1$ is a $C_{10}$-$C_{18}$ alkyl or alkenyl group; A is an alkoxy group selected from ethoxy, propoxy, and mixtures thereof; x represents mole percentage average from 0.1 to 0.9; and M is an cation, wherein the cation is selected from an alkali metal, alkali earth metal, ammonium group, or alkanolammonium group; (ii) 40% to 44% of a co-surfactant by weight of the surfactant system, wherein the co-surfactant is an amine oxide, preferable alkyldimethylamine oxide; and (iii) 15% to 19% of a nonionic surfactant by weight of the surfactant system, wherein the nonionic surfactant is alcohol ethoxylate nonionic surfactant; (b) 30% to 90% water by weight of the liquid dish detergent; and (c) pH is from 8 to 10.

Another aspect of the invention provides for a method of cleaning a dish with a liquid dish detergent composition according to any one of the proceeding claims, said method comprising the steps of applying the composition onto the dish or in a dish washing basin or a dish cleaning implement.

Another aspect of the invention provides for a use of a composition according to any proceeding claim to achieve a squeaky clean feel on a target surface, preferably wherein the target surface is a dish.

DETAILED DESCRIPTION OF THE INVENTION

As used herein "liquid detergent composition" refers to those compositions that are employed in a variety of cleaning uses including dishes, or hard surfaces (e.g., floors, countertops etc), laundry, hair (e.g., shampoos), body, and the like. A preferred liquid detergent composition of the present invention is a "liquid dish detergent composition," which refers to those compositions that are employed in manual (i.e. hand) dish washing. Such compositions are generally high sudsing or foaming in nature. By "dish," the term include dishes, glasses, pots, pans, baking dishes, flatware and the like, made from ceramic, china, metal, glass, plastic (polyethylene, polypropylene, polystyrene, etc.), wood and the like.

Surfactant System

One aspect of the invention provides for a surfactant system generally comprising an anionic surfactant, co-surfactant, and nonionic surfactant. The surfactant system comprises from 1% to 60%, preferably from 5% to 50%, more preferably from 8% to 40% by weight of the liquid detergent composition. Alternatively, the surfactant system comprises from 26% to 38%, alternatively from 28% to 36%, alternatively combinations thereof, by weight of the liquid detergent composition.

Alkyl Sulphate Surfactant

One aspect of the invention provides an alkyl sulphate surfactant of the formula defined below, comprising 35% to 49%, preferably 37% to 47%, more preferably from 40% to 44%, alternatively combinations thereof, by weight of the surfactant system.

The alkyl sulphate surfactant of the present invention have the formula: $R_1O(A)_xSO_3M$, wherein the variable are herein defined. "$R_1$" is a $C_1$-$C_{21}$ alkyl or alkenyl group, preferably from $C_8$-$C_{20}$, more preferably from $C_{10}$-$C_{18}$. The alkyl or alkenyl group may be branched or linear. Where the alkyl or alkenyl group is branched, it preferably comprises $C_{1-4}$ alkyl branching units. The average weight percentage branching of the alkyl sulphate surfactant is preferably greater than 10%, more preferably from 15% to 80%, and most preferably from 20% to 40%, alternatively from 21% to 28%, alternatively combinations thereof. The branched alkyl sulphate surfactant can be a single alkyl sulphate surfactant or a mixture of alkyl sulphate surfactants. In the case of a single surfactant, the percentage of branching refers to the weight percentage of the hydrocarbyl chains that are branched in the original alcohol from which the surfactant is derived. In the case of a surfactant mixture, the percentage of branching is the weight average and it is defined according to the following formula: Weight average of branching (%)=[(x1*wt % branched alcohol 1 in alcohol 1+x2*wt % branched alcohol 2 in alcohol 2+ . . . )/(x1+x2+ . . . )]*100; wherein x1, x2, . . . are the weight in grams of each alcohol in the total alcohol mixture of the alcohols which were used as starting material for the anionic surfactant. In the weight average branching degree calculation the weight of alkyl sulphate surfactant components not having branched groups should also be included.

Turning back to the above formula, "A" is an alkoxy group, preferably a $C_1$-$C_5$ alkoxy group, more preferably a $C_1$-$C_3$ alkoxy group, yet more preferably the alkoxy group is selected from ethoxy, propoxy, and mixtures thereof. In one embodiment, the alkoxy group is ethoxy. "x" represents a mole percentage average below 1, preferably from 0 to below 1, more preferably from 0.1 to 0.9, alternatively from 0.2 to 0.8, alternatively combinations thereof.

For purposes of clarification, the formula above describes certain alkyl alkoxy sulfates; more preferably the formula describes a mixture of alkyl sulfates and alkyl alkoxy sulfates such that the alkoxylation on mole percentage average (i.e., variable "x") is below 1. In the case of a surfactant mixture, the average degree of alkoxylation is the mole percent average and it is defined according to the following formula: Mole average degree of alkoxylation= [(y0*0+y1*1+y2*2+ . . . )/(y0+y1+y2+ . . . )]; wherein y0, y1, y2, . . . are the mole percent of each sulphated surfactant in the total alkyl mixture of sulphated surfactants having respectively 0, 1, 2, . . . alkoxy units which are present in the detergent of the invention. For example, an alkyl sulphate of the following formula $CH_3(CH_2)_{13}SO_4Na$ will have a y value of 0 (i.e., y0). An alkylethoxysulfate of the following formula $CH_3(CH_2)_{13}(OCH_2CH_2)SO_4Na$ will have a y value of 1 (i.e., y1). An alkylethoxysulfate of the following formula: $CH_3(CH_2)_{10}(OCH_2CH_2)_4SO_4Na$ will have an y value of 4 (i.e., y4). The mole amount of each the three molecules is taken into account to ultimately calculate the mole percentage average of variable "x" (in the formula $R_1O(A)_xSO_3M$).

Regarding the formula $R_1O(A)_xSO_3M$, "M" is a cation, preferably the cation is selected from an alkali metal, alkali earth metal, ammonium group, or alkanolammonium group; more preferably the cation is sodium.

The detergent composition can optionally further comprise other anionic surfactants. Non-limiting examples include sulphonate, carboxylate, sulfosuccinate and sulfoacetate anionic surfactants.

Co-Surfactants

One aspect of the invention provides a co-surfactant (defined below) comprising 35% to 49%, preferably 37% to 47%, more preferably from 40% to 44%, alternatively combinations thereof, by weight of the surfactant system. The co-surfactant is selected from an amphoteric surfactant, a zwitterionic surfactant, and mixtures thereof. In a preferred embodiment, the composition of the present invention will preferably comprise an amine oxide as the amphoteric surfactant or betaine as the zwitterionic surfactant, or a mixture of said amine oxide and betaine surfactants.

Preferably the co-surfactant comprises an amphoteric surfactant and wherein the amphoteric surfactant comprises at least 40%, preferably at least 50%, more preferably at least 60% by weight of an amine oxide surfactant. Alternatively the primary co-surfactant comprises an amphoteric and a zwitterionic surfactant and wherein the amphoteric and the zwitterionic surfactant preferably are in a weight ratio of from about 2:1 to about 1:2, more preferably wherein the amphoteric surfactant is an amine oxide surfactant and the zwitteronic surfactant is a betaine. Most preferably the co-surfactant is an amine oxide, especially alkyl dimethyl amine oxide.

Most preferred among the amphoteric surfactants are amine oxides, especially coco dimethyl amine oxide or coco amido propyl dimethyl amine oxide Amine oxide may have a linear or mid-branched alkyl moiety. Typical linear amine oxides include water-soluble amine oxides containing one R1 $C_{8-18}$ alkyl moiety and 2 R2 and R3 moieties selected from the group consisting of $C_{1-3}$ alkyl groups and $C_{1-3}$ hydroxyalkyl groups. Preferably amine oxide is characterized by the formula R1-N(R2)(R3)O wherein $R_1$ is a $C_{8-18}$ alkyl and $R_2$ and $R_3$ are selected from the group consisting of methyl, ethyl, propyl, isopropyl, 2-hydroxethyl, 2-hydroxypropyl and 3-hydroxypropyl. The linear amine oxide surfactants in particular may include linear $C_{10}$-$C_{18}$ alkyl dimethyl amine oxides and linear $C_8$-$C_{12}$ alkoxy ethyl dihydroxy ethyl amine oxides. Preferred amine oxides include linear $C_{10}$, linear $C_{10}$-$C_{12}$, and linear $C_{12}$-$C_{14}$ alkyl dimethyl amine oxides. As used herein "mid-branched" means that the amine oxide has one alkyl moiety having $n_1$ carbon atoms with one alkyl branch on the alkyl moiety having $n_2$ carbon atoms. The alkyl branch is located on the a carbon from the nitrogen on the alkyl moiety. This type of branching for the amine oxide is also known in the art as an internal amine oxide. The total sum of $n_1$ and $n_2$ is from 10 to 24 carbon atoms, preferably from 12 to 20, and more preferably from 10 to 16. The number of carbon atoms for the one alkyl moiety ($n_1$) should be approximately the same number of carbon atoms as the one alkyl branch ($n_2$) such that the one alkyl moiety and the one alkyl branch are symmetric. As used herein "symmetric" means that $|n_1-n_2|$ is less than or equal to 5, preferably 4, most preferably from 0 to 4 carbon atoms in at least 50 wt %, more preferably at least 75 wt % to 100 wt % of the mid-branched amine oxides for use herein.

The amine oxide further comprises two moieties, independently selected from a $C_{1-3}$ alkyl, a $C_{1-3}$ hydroxyalkyl group, or a polyethylene oxide group containing an average of from about 1 to about 3 ethylene oxide groups. Preferably the two moieties are selected from a $C_{1-3}$ alkyl, more preferably both are selected as a $C_1$ alkyl.

Most preferred among the zwitterionic surfactants are betaines, such as alkyl betaines, alkylamidobetaine, amidazoliniumbetaine, sulfobetaine (INCI Sultaines) as well as the Phosphobetaine and preferably meets formula I:

$$R^1—[CO—X(CH_2)_n]_x—N^+(R^2)(R_3)—(CH_2)_m—[CH(OH)—CH_2]_y—Y—\text{(I) wherein}$$

$R^1$ is a saturated or unsaturated C6-22 alkyl residue, preferably C8-18 alkyl residue, in particular a saturated C10-16 alkyl residue, for example a saturated C12-14 alkyl residue;

X is NH, $NR^4$ with C1-4 Alkyl residue $R^4$, O or S, n is a number from 1 to 10, preferably 2 to 5, in particular 3, x is 0 or 1, preferably 1, $R^2$, $R^3$ are independently a C1-4 alkyl residue, potentially hydroxy substituted such as a hydroxyethyl, preferably a methyl.

m is a number from 1 to 4, in particular 1, 2 or 3, y is 0 or 1 and

Y is COO, SO3, OPO(OR5)O or P(O)(OR5)O, whereby R5 is a hydrogen atom H or a C1-4 alkyl residue.

Preferred betaines are the alkyl betaines of the formula (Ia), the alkyl amido betaine of the formula (Ib), the Sulfo betaines of the formula (Ic) and the Amido sulfobetaine of the formula (Id);

$$R^1—N^+(CH_3)_2—CH_2COO^- \quad (Ia)$$

$$R^1—CO—NH(CH_2)_3—N^+(CH_3)_2—CH_2COO^- \quad (Ib)$$

$$R^1—N^+(CH_3)_2—CH_2CH(OH)CH_2SO_3— \quad (Ic)$$

$R^1—CO—NH—(CH_2)_3—N^{30}$ $(CH_3)_2—CH_2CH(OH)CH_2SO_3—$ (Id) in which $R^1$1 as the same meaning as in formula I. Particularly preferred betaines are the Carbobetaine [wherein $Y^-$=$COO^-$], in particular the Carbobetaine of the formula (Ia) and (Ib), more preferred are the Alkylamidobetaine of the formula (Ib).

Examples of suitable betaines and sulfobetaine are the following [designated in accordance with INCI]: Almondamidopropyl of betaines, Apricotam idopropyl betaines, Avocadamidopropyl of betaines, Babassuamidopropyl of betaines, Behenam idopropyl betaines, Behenyl of betaines, betaines, Canolam idopropyl betaines, Capryl/Capram idopropyl betaines, Carnitine, Cetyl of betaines, Cocamidoethyl of betaines, Cocam idopropyl betaines, Cocam idopropyl Hydroxysultaine, Coco betaines, Coco Hydroxysultaine, Coco/Oleam idopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucam idopropyl Hydroxysultaine, Hydrogenated Tallow of betaines, Isostearam idopropyl betaines, Lauram idopropyl betaines, Lauryl of betaines, Lauryl Hydroxysultaine, Lauryl Sultaine, Milkam idopropyl betaines, Minkamidopropyl of betaines, Myristam idopropyl betaines, Myristyl of betaines, Oleam idopropyl betaines, Oleam idopropyl Hydroxysultaine, Oleyl of betaines, Olivamidopropyl of betaines, Palmam idopropyl betaines, Palm itam idopropyl betaines, Palmitoyl Carnitine, Palm Kernelam idopropyl betaines, Polytetrafluoroethylene Acetoxypropyl of betaines, Ricinoleam idopropyl betaines, Sesam idopropyl betaines, Soyam idopropyl betaines, Stearam idopropyl betaines, Stearyl of betaines, Tallowam idopropyl betaines, Tallowam idopropyl Hydroxysultaine, Tallow of betaines, Tallow Dihydroxyethyl of betaines, Undecylenam idopropyl betaines and Wheat Germam idopropyl betaines.

A preferred betaine is, for example, Cocoamidopropyl betaines (Cocoamidopropylbetain).

The co-surfactant is selected from an amphoteric surfactant, zwitterionic surfactant, and mixtures thereof. In one embodiment, the amphoteric surfactant comprises at least 60% of an amine oxide by weight of the amphoteric surfactant, and the zwitterionic surfactant is a betaine. In another embodiment, the co-surfactant comprises the amphoteric surfactant and the zwitterionic surfactant, wherein the amphoteric surfactant and the zwitterionic surfactant are preferably in a weight ratio of from 2:1 to 1:2, respectively. In another embodiment, the co-surfactant is the amphoteric surfactant and the zwitteronic surfactant, wherein the amphoteric surfactant is an amine oxide surfactant and the zwitteronic surfactant is a betaine, and the weight ratio of the amine oxide surfactant to the betaine is about 1:1. In another embodiment, the co-surfactant is an amine oxide surfactant; and wherein the nonionic surfactant is an alcohol ethoxylate nonionic surfactant. In yet another embodiment, the co-surfactant is an alkyldimethylamine oxide surfactant.

Nonionic Surfactants

One aspect of the invention provides 12% to 22%, preferably from 15% to 19% of a nonionic surfactant by weight of the surfactant system. Suitable nonionic surfactants include the condensation products of aliphatic alcohols with from 1 to 25 moles of alkylene oxide, preferably ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 8 to 18 carbon atoms, preferably from 10 to 15 carbon atoms, alternatively from 9 to 11 carbon atoms, alternatively from 12 to 14 carbon atoms, alternatively combinations thereof; with from 2 to 18 moles, preferably 2 to 15 moles, more preferably 5 to 12 moles of ethylene oxide per mole of alcohol. In one embodiment, the nonionic surfactant is an aliphatic alcohol with from 1 to 25 moles of ethylene oxide, preferably condensation products of alcohols having an alkyl group containing from 8 to 18 carbon atoms, with from 2 to 18 moles of ethylene oxide per mole of alcohol.

Also suitable are alkylpolyglycosides having the formula $R^2O(C_nH_{2n}O)_t(\text{glycosyl})_x$ (formula (III)), wherein $R^2$ of formula (III) is selected from the group consisting of alkyl, alkyl-phenyl, hydroxyalkyl, hydroxyalkylphenyl, and mixtures thereof in which the alkyl groups contain from 10 to 18, preferably from 12 to 14, carbon atoms; n of formula (III) is 2 or 3, preferably 2; t of formula (III) is from 0 to 10, preferably 0; and x of formula (III) is from 1.3 to 10, preferably from 1.3 to 3, most preferably from 1.3 to 2.7. The glycosyl is preferably derived from glucose. Also suitable are alkylglycerol ethers and sorbitan esters.

Also suitable are fatty acid amide surfactants having the formula (IV):

$$R^6\overset{\overset{\displaystyle O}{\|}}{C}N(R^7)_2 \quad (IV)$$

wherein $R^6$ of formula (IV) is an alkyl group containing from 7 to 21, preferably from 9 to 17, carbon atoms and each $R^7$ of formula (IV) is selected from the group consisting of hydrogen, $C_1$-$C_4$ alkyl, $C_1$-$C_4$ hydroxyalkyl, and —$(C_2H_4O)_xH$ where x of formula (IV) varies from 1 to 3. Preferred amides are $C_8$-$C_{20}$ ammonia amides, monoethanolamides, diethanolamides, and isopropanolamides.

Most preferably the nonionic surfactant is a condensation product of an aliphatic alcohol with ethyleneoxide.

In a preferred embodiment, the compositions of the present invention are free or substantially free of cationic surfactants.

Water

The liquid detergent compositions preferably comprise water. The water may be added to the composition directly or may be brought into the composition with raw materials. In any event, the total water content of the composition herein may comprise from 10% to 95% water by weight of the liquid dish detergent compositions. Alternatively, the composition may comprise from 20% to 95%, alternatively from 30% to 90%, or from 40% to 85%, or from 20% to 30%, alternatively combinations thereof, of water by weight of the liquid dish detergent composition.

Organic Solvents

The present compositions may optionally comprise an organic solvent. Suitable organic solvents include $C_{4-14}$ ethers and diethers, polyols, glycols, alkoxylated glycols, $C_6$-$C_{16}$ glycol ethers, alkoxylated aromatic alcohols, aromatic alcohols, aliphatic linear or branched alcohols, alkoxylated aliphatic linear or branched alcohols, alkoxylated $C_1$-$C_5$ alcohols, $C_8$-$C_{14}$ alkyl and cycloalkyl hydrocarbons and halohydrocarbons, and mixtures thereof. Preferably the organic solvents include alcohols, glycols, and glycol ethers, alternatively alcohols and glycols. In one embodiment, the liquid detergent composition comprises from 0% to less than 50% of a solvent by weight of the composition. When present, the liquid detergent composition will contain from 0.01% to 20%, alternatively from 0.5% to 15%, alternatively from 1% to 10% by weight of the liquid detergent composition of said organic solvent. These organic solvents may be used in conjunction with water, or they may be used without water. Non-limiting examples of specific solvents include propylene glycol, polypropylene glycol, propylene glycol phenyl ether, ethanol, and combinations thereof. In one embodiment, the composition comprises from 0.01% to 20% of an organic solvent by weight of the composition, wherein the organic solvent is selected from glycols, polyalkyleneglycols, glycol ethers, ethanol, and mixtures thereof.

Hydrotrope

The liquid detergent compositions optionally comprises a hydrotrope in an effective amount, i.e. from 0% to 15%, or from 0.5% to 10%, or from 1% to 6%, or from 0.1% to 3%, or combinations thereof, so that the liquid dish detergent compositions are compatible or more compatible in water. Suitable hydrotropes for use herein include anionic-type hydrotropes, particularly sodium, potassium, and ammonium xylene sulfonate, sodium, potassium and ammonium toluene sulfonate, sodium potassium and ammonium cumene sulfonate, and mixtures thereof, as disclosed in U.S. Pat. No. 3,915,903. In one embodiment, the composition of the present invention is isotropic. An isotropic composition is distinguished from oil-in-water emulsions and lamellar phase compositions. Polarized light microscopy can assess whether the composition is isotropic. See e.g., *The Aqueous Phase Behaviour of Surfactants*, Robert Laughlin, Academic Press, 1994, pp. 538-542. In one embodiment, an isotropic dish detergent composition is provided. In one embodiment, the composition comprises 0.1% to 3% of a hydrotrope by weight of the composition, preferably wherein the hydrotrope is selected from sodium, potassium, and ammonium xylene sulfonate, sodium, potassium and ammonium toluene sulfonate, sodium potassium and ammonium cumene sulfonate, and mixtures thereof.

Calcium/Magnesium Ions

Calcium ion and/or Magnesium ion, preferably Magnesium ion, are added, preferably as a hydroxide, chloride, acetate, sulphate, formate, oxide or nitrate salt, to the compositions of the present invention, typically at an active level of from 0.01% to 1.5%, preferably from 0.015% to 1%, more preferably from 0.025% to 0.5%, by weight of the liquid detergent composition. In one embodiment, the composition comprises from 0.01% to 1.5% of a calcium ion or magnesium ion, or mixtures thereof, by weight of the composition, preferably the magnesium ion.

Adjunct Ingredients

The liquid detergent compositions herein can optionally further comprise a number of other adjunct ingredients suitable for use in liquid detergent compositions such as perfume, colorants, pearlescent agents, opacifiers, suds stabilizers/boosters, cleaning and/or shine polymers, rheology modifying polymers, structurants, chelants, skin care actives, suspended particles, enzymes, anti-caking agents, viscosity trimming agents (e.g. salt such as NaCl and other mono-, di- and trivalent salts), preservatives and pH trimming and/or buffering means (e.g. carboxylic acids such as citric acid, HCl, NaOH, KOH, alkanolamines, phosphoric and sulfonic acids, carbonates such as sodium carbonates, bicarbonates, sesquicarbonates, borates, silicates, phosphates, imidazole and alike).

pH

The liquid detergent compositions herein preferably have a pH adjusted to between 3 and 14, more preferably between 4 and 13, more preferably between 6 and 12, most preferably between 8 and 10, alternatively from 8.5 to 9.5, alternatively combinations thereof. pH is determined by the liquid detergent composition diluted with deionized water making a 10% product concentration by weight (i.e., 10% product and 90% water, by weight). The pH of the composition can be adjusted using pH trimming and/or buffering means known in the art.

Viscosity

The liquid detergent compositions of the present invention can be in the form of a liquid, semi-liquid, cream, lotion or gel compositions and, in some embodiments, are intended for use as liquid hand dishwashing detergent compositions for direct or indirect application onto dishware. These compositions include single phase Newtonian or non-Newtonian products with a high shear viscosity of between 1 centipoises (cps) and 10,000 cps at 20° C. and, alternatively between 10 cps and 8000 cps, or between 200 cps and 5000 cps, or between 300 cps and 3000 cps, or between 400 and 2000 cps, or between 500 and 1750 cps, or between 1000 and 1500 cps, or 300 cps to 700 cps, or from 400 cps to 800 cps, alternatively combinations thereof.

Viscosity is measured with a BROOFIELD DV-E viscometer, at 20° C., spindle number 31. The following rotations per minute (rpm) should be used depending upon the viscosity: between 300 cps to below 500 cps is at 50 rpm; between 500 cps to less than 1,000 cps is at 20 rpm; from 1,000 cps to less than 1,500 cps at 12 rpm; from 1,500 cps to less than 2,500 cps at 10 rpm; from 2,500 cps, and greater, at 5 rpm. Those viscosities below 300 cps are measured at 12 rpm with spindle number 18.

Packaging

The liquid detergent compositions of the present invention may be packed in any suitable packaging for delivering the liquid detergent composition for use. In one preferred embodiment, the package may be comprised of polyethylene terephthalate, high-density polyethylene, low-density polyethylene, or combinations thereof. Furthermore, preferably, the package may be dosed through a cap at the top of the package such that the composition exits the bottle through an opening in the cap. The cap may be a push-pull cap or a flip top cap.

Process of Cleaning/Treating a Dishware

Another embodiment of the present invention is directed to a process of cleaning dishes with a composition of the present invention. The process comprises the step(s) of applying the composition onto the dish surface, typically in diluted or neat form, and rinsing the dish.

In one embodiment of the present invention, the composition herein can be applied in its diluted form. The soiled dishes are immersed in the sink containing the diluted compositions then obtained, where contacting the soiled surface of the dish with a cloth, sponge, or similar article cleans them. The cloth, sponge, or similar article may be immersed in the detergent composition and water mixture prior to being contacted with the dish surface. The contacting of cloth, sponge, or similar article to the dish surface is preferably accompanied by a concurrent scrubbing of the dish surface.

Another method of the present invention will comprise immersing the soiled dishes into a water bath or held under running water without any liquid dishwashing detergent. A device for absorbing liquid dishwashing detergent, such as a sponge, is placed directly into a separate quantity of undiluted liquid dishwashing composition. The absorbing device, and consequently the undiluted liquid dishwashing composition, is then contacted individually to the surface of each of the soiled dishes to remove said soiling. The contacting of the absorbing device to the dish surface is preferably accompanied by concurrent scrubbing.

Alternatively, the device may be immersed in a mixture of the hand dishwashing composition and water prior to being contacted with the dish surface, the concentrated solution is made by diluting the hand dishwashing composition with water in a small container that can accommodate the cleaning device.

In one embodiment, a method of cleaning a dish with a liquid dish detergent composition described herein, said method comprising the steps of applying the composition onto the dish or in a dish washing basin or a dish cleaning implement. In another embodiment, the use of a composition described herein is used to achieve a squeaky clean feel on a target surface, preferably wherein the target surface is a dish.

Data

The table below provides rinse and feel data between comparative examples (i.e., Ex. 1 to Ex. 3), and inventive examples (Ex. 4 to Ex. 6). Composition components (on weight percentage basis), as well as pH, viscosity, and rinse and feel data are provided.

| Component (Wt %) | Ex. 1 Comp. | Ex. 2 Comp. | Ex. 3 Comp. | Ex. 4 Invent. | Ex. 5 Invent. | Ex. 6 Invent. |
|---|---|---|---|---|---|---|
| AES[A] (avg EO = 0.6) | 23.94 | 23.94 | 23.1 | 12.9 | 12.9 | 12.9 |
| Amine Oxide[B] | 6.84 | 6.84 | 7.7 | 12.9 | 12.9 | 12.9 |
| Nonionic Surfactant[C] | 0.46 | 0.46 | 0.45 | 5.46 | 5.46 | 5.46 |
| Total Surfactant System | 31.25 | 31.25 | 31.25 | 31.25 | 31.25 | 31.25 |
| Wt % in composition: | | | | | | |
| Wt % of AES, AO, NI in | 76.6; 21.9; | 76.6; 21.9; | 73.9; 24.6; | 41.3; 41.3; | 41.3; 41.3; | 41.3; 41.3; |
| Total Surfactant System: | 1.5 | 1.5 | 1.4 | 17.5 | 17.5 | 17.5 |
| Sodium Chloride | 0.99 | 0.99 | 0.99 | 0.8 | 0.8 | 1 |
| Ethanol | 5.1 | 4.59 | 4.4 | 2 | 6.4 | 8 |
| Propylene Glycol | 9.5 | 9.5 | 9.5 | 3.5 | 9.5 | 0 |
| Phenyl Ether | | | | | | |
| Propylene Glycol | 12 | 12 | 12 | 4 | 11 | 0 |
| Sodium Cumenesulfonate | 4 | 4 | 4 | 1 | 3.4 | 0 |
| Water and adjunct | Up to | Up to | Up to | Up to | Up to | Up to |
| ingredients: | 100 | 100 | 100 | 100 | 100 | 100 |
| pH (10% solution): | 9 | 9 | 9 | 9 | 9 | 9 |
| Viscosity (cps): | 40 | 40 | 40 | 300 | 40 | 300 |
| Data: | | | | | | |
| Rinse & Feel (higher is better)[D] | 1, 0, 0 | 1, 0, 0 | 1, 1.5, 1.5 | 3 | 2.5, 3, 3 | 3 |

[A]"AES" is $C_{12}$-$C_{13}$ alkyl ethoxy sulphate with an average mole percentage of ethoxyation of 0.6, with average alkyl branching of about 24%-25%. Non-sulphated alcohol and alcohol ethoxylates are obtained from suppliers, wherein the appropriate ratios of each are mixed together internally (to achieve the appropriate ethoxylation and branching), and then the alcohol mixture is sulphated also internally (P&G).

[B]"Amine Oxide" is $C_{12}$-$C_{14}$ alkyl dimethyl amine oxide ex ICL.

[C]"Nonionic Surfactant" in all examples (Ex. 1-Ex. 6) have Lutensol ™ XP80 ex BASF (0.46%). Examples 4-6 also have Greenbentin DE/080 ex Kolb (5%).

[D]Rinse & Feel is assessed. To assess the rinse feel profile of a detergent composition, a 20% detergent solution is prepared with soft water (2.8 dH) of 20 degrees Celsius (C.) for both the reference and the test product. A cellulosic sponge (Artikel Nr. 33100200 - Materialnummer Z 1470000 - ex MAPA GmbH - Bereich SPONTEX Industrie), cut to 9 cm by 4 cm by 4 cm, is wetted with water and squeezed till no water drips out anymore. 10 ml of the 20% detergent solution is applied on the pre-wetted cellulosic sponge. Both sponges are consequently squeezed 5x by hand, one hand holding the reference sponge, the other hand holding the testing sponge and targeting to apply about the same squeezing force across both hands. Both hands are consequently rinsed under running soft tap water of 20 degrees C., and the slippery feel on hands while rinsing is graded following below grading scale. The test is repeated 3 times, each replicate done by a different grader, and switching test and reference products between dominant and non dominant hands, and the average datapoint is reported. The scale is from 1 to 5, wherein 1 is the least desirable, i.e., slippery and 5 is most desirable, i.e., dry. 3 is neither slipper nor dry, i.e. in between slippery and dry.

As the data demonstrates, the inventive compositions of Example 4, 5, and 6 and the described surfactant system and the weight percentage ratios of the anionic surfactants, co-surfactant, and non-ionic surfactant, achieve a higher rinse feel benefit relative to the comparative compositions.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid detergent composition comprising:

(a) 26% to 38% of a surfactant system by weight of the composition, wherein the surfactant system comprises:

(i) 35% to 49% of an alkyl sulphate surfactant by weight of the surfactant system, wherein the alkyl sulphate surfactant has the formula: $R_1O(A)_xSO_3M$, wherein:

a. $R_1$ is a $C_{12}$-$C_{13}$ alkyl group;

b. A is an ethoxy group;

c. x represents mole percentage of ethoxylation of 0.6; and d. M is a cation, wherein the alkyl sulphate surfactant has an average alkyl branching of between about 24% and about 25%;

(ii) 35% to 49% of co-surfactant by weight of the surfactant system, wherein the co-surfactant comprises at least 60% by weight of an amphoteric surfactant, wherein said amphoteric surfactant is an amine oxide surfactant, wherein said amine oxide surfactant is an alkyldimethylamine oxide surfactant;

(iii) 12% to 22% of a nonionic surfactant by weight of the surfactant system, wherein the nonionic surfactant is a condensation product of an aliphatic alcohol having an alkyl group containing from 9 to 11 carbon atoms with from 5 to 12 moles of ethylene oxide per mole of alcohol;

(b) from 10% to 95% water by weight of the composition;

wherein the alkyl sulphate surfactant and the co-surfactant are in a weight ratio of about 1:1 and the alkyl sulphate surfactant and the nonionic surfactant are in a weight ratio of about 2.4:1; and wherein the composition is free of cationic surfactant.

2. A composition according to claim 1, wherein the co-surfactant further comprises a zwitterionic surfactant, wherein the amphoteric surfactant and the zwitterionic surfactant are in a weight ratio of about 2:1 respectively.

3. A composition according to claim 2, wherein the zwitteronic surfactant is a betaine.

4. The composition of claim 1, wherein the co-surfactant is a C12-C14 alkyldimethylamine oxide surfactant.

5. The composition of claim 1, wherein the composition is a liquid dish detergent composition.

6. The composition of claim 1, wherein the water is from 30% to 90% by weight of the composition.

7. The composition of claim 1, further comprising from 0.01% to 20% of an organic solvent by weight of the composition, wherein the organic solvent is selected from the group consisting of glycols, polyalkyleneglycols, glycol ethers, ethanol, and mixtures thereof.

8. The composition of claim 1, further comprising 0.5% to 10% of a hydrotrope by weight of the composition, wherein the hydrotrope is selected from the group consisting of sodium, potassium, and ammonium xylene sulfonate, sodium, potassium and ammonium toluene sulfonate, sodium potassium and ammonium cumene sulfonate, and mixtures thereof.

9. The composition according to claim 1, further comprising from 0.01% to 1.5% by weight of the composition of a magnesium ion.

10. The composition of claim 1, wherein the cation is selected from an alkali metal, alkali earth metal, ammonium group, or alkanolammonium group.

11. The composition of claim 10, wherein the cation is sodium.

12. The liquid detergent composition of claim 1 having a pH from 8 to 10.

* * * * *